US005839586A

United States Patent [19]

Smith

[11] Patent Number: 5,839,586

[45] Date of Patent: Nov. 24, 1998

[54] I. V. BAG CAROUSEL ORGANIZER

[76] Inventor: Norman A. Smith, 2575 Saint Nick Ave., New Orleans, La. 70131

[21] Appl. No.: 897,143

[22] Filed: Jul. 21, 1997

Related U.S. Application Data

[63] Continuation-in-part of Ser. No. 492,255, Jun. 22, 1995, abandoned.

[51] Int. Cl.[6] ..... A47F 7/00

[52] U.S. Cl. ..... 211/163; 211/58; 211/59.1; 312/135; 312/236

[58] Field of Search ..... 211/163, 59.1, 211/57.1, 58, 78; 248/415; 312/135, 305, 236

[56] References Cited

U.S. PATENT DOCUMENTS

| | | | |
|---|---|---|---|
| 978,670 | 12/1910 | Solomon | 211/163 |
| 2,071,290 | 2/1937 | Scriba | 211/58 |
| 2,418,062 | 3/1947 | Abrahamson | 312/135 X |
| 3,319,800 | 5/1967 | Bowles | 211/163 |
| 3,788,489 | 1/1974 | Levinthal | 211/163 |
| 3,827,571 | 8/1974 | Koutny | 211/59.1 |
| 3,999,821 | 12/1976 | Moody et al. | 312/236 |
| 4,971,204 | 11/1990 | Alsobrook | 211/58 X |
| 5,277,488 | 1/1994 | Cleary et al. | 312/305 X |

*Primary Examiner*—Robert W. Gibson, Jr.
*Attorney, Agent, or Firm*—Robert N. Montgomery

[57] ABSTRACT

An apparatus for organizing and hanging a plurality of I.V. bags on a carousel for use primarily in a refrigerator which includes a central column having disk spacable there along which are rotatable relative to the central column, the disk further being equipped with a plurality of hangers for organizing I.V. bags held in refrigerated suspension prior to dispersion to patients.

6 Claims, 2 Drawing Sheets

I. V. BAG CAROUSEL ORGANIZER

This application is a continuation-in-part of application Ser. No. 08/492,255, filed Jun. 22, 1995, now abandoned.

BACKGROUND OF THE INVENTION

1. Field of the Invention

This invention relates generally to the organization of bags containing fluidized medicaments. More specifically the invention relates to the organization of intravenous bag medicaments while in refrigerated storage prior to dispersal to patients.

2. General Background

Intravenous fluidized medicaments are generally provided in a bag or container having connection for attachments to hoses, tubes, valves etc. These bags are generally collapsible and are designed to be suspended at one end from a support member such as an I.V. pole. Each bag contains a premeasured amount of the medicament sealed in the bag and is equipped with various attachments connected thereto. In some cases these bags are required to be refrigerated prior to infusion into the patient. As a result the bags are generally placed on a shelf in the pharmacy refrigerator or other refrigerators located near the patient. In cases where several patients are being medicated with such intravenous medicaments, it sometimes becomes confusing as to which medication is assigned to which patient or the sequencing of such medication. Since the bags are not suspended and are simply placed in a reclining position on the refrigerator shelves, the bags become mixed and shuffled repeatedly each time one is removed from the refrigerator. Further confusion exists as a result of various size bags. Rummaging through these bags several times per shift makes an accurate inventory difficult at best. Aside from causing inconvenience and inefficiencies in the handling of the I.V. bags by hospital staff, this may result in incorrect infusion of the patient with the medicament. The present invention recognizes the need for an apparatus for organizing I.V. bags to be stored in a special environment or otherwise held for use in an organized manner for patients.

SUMMARY OF THE PRESENT INVENTION

The preferred embodiment of the I.V. bag organizer includes a tubular section having a base support member and at least two rotatable hanger members at spaced apart intervals individually positionable at intervals along a central tubular section. Each rotatable hanger has a plurality of support arms for holding I.V. bags in their normal hanging position. The apparatus also has measurements which allow for its placement in a commercial refrigerator by removing the existing shelves. I.V. bags of different sizes can be placed on the support sequentially according to type of medication or by patient name thus, making it simple for medical staffer to located a particular medication and confirm by patient name. Rotating the hanger members allows fast, easy access and inventory as well as reorganizing and resupplying after each nursing shift.

BRIEF DESCRIPTION OF THE DRAWINGS

For a further understanding of the nature and objects of the present invention, reference should be had to the following detailed description taken in conjunction with the accompanying drawings, in which, like parts are given like reference numerals, and wherein.

DETAILED DESCRIPTION OF THE PREFERRED EMBODIMENT

Figure 1:
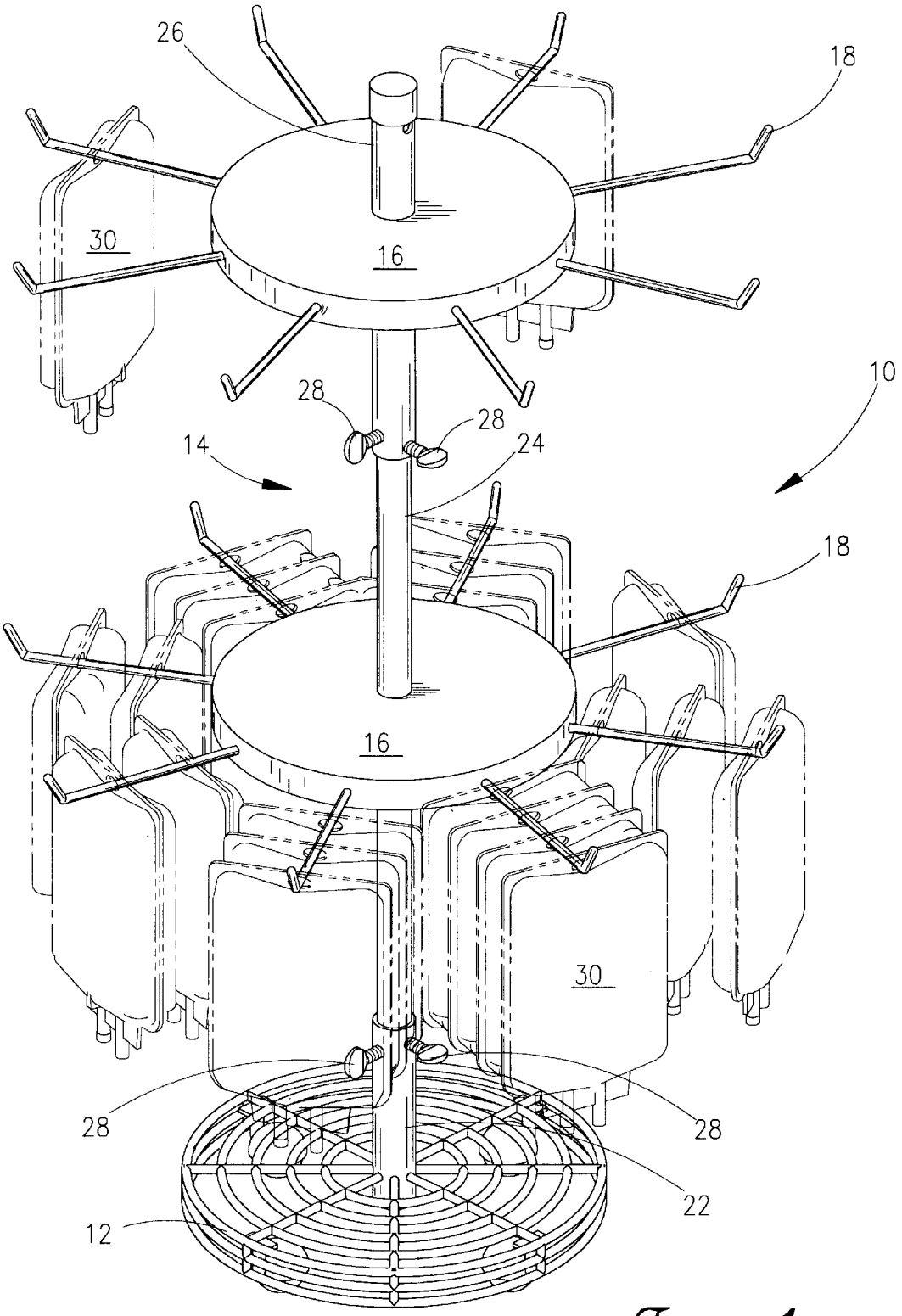
FIG.1 is an isometric view of the apparatus with I.V. bags shown hanging therefrom.
Figure 2:
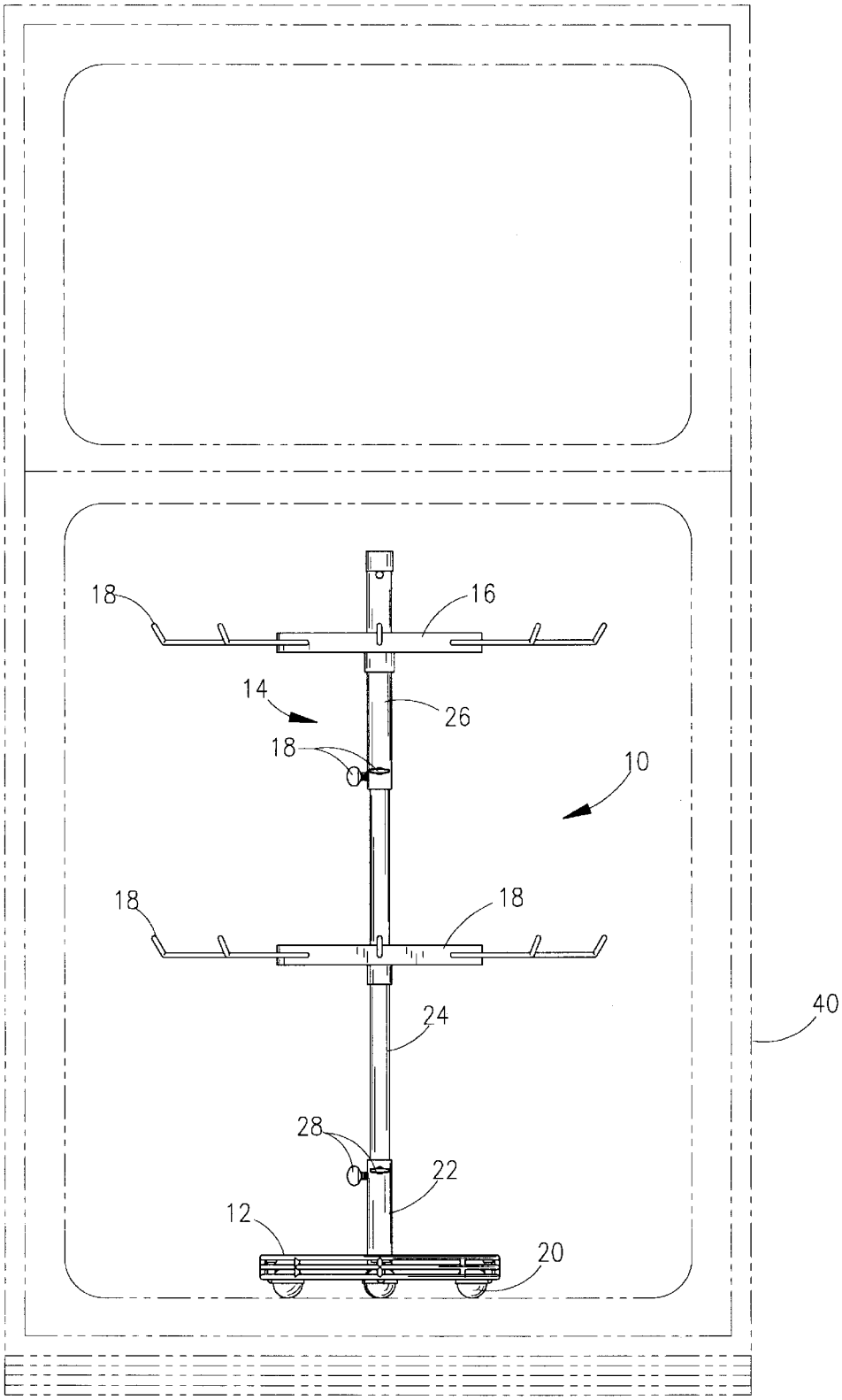
FIG. 2 is a vertical elevation of the apparatus shown in position in a refrigerator.

As first seen in FIG. 1 the instant invention 10 is comprised of a base frame 12; an extendable central column 14; two circular disk members 16, rotatable relative to the central column 14, and a series of hangers 18, extending horizontally from the rotatable disk members 16 for supporting I.V. bags 30. The base frame 12 may be of any suitable configuration and may include a basket for holding ancillary products. The base frame 12 may be equipped with wheels 20 for use in transport to and from a refrigerator 40 such as from a pharmacy to a nursing station. The base frame 12 supports the central column 14 which further comprises a lower tubular section 22; a central column 24 which is telescopically adjustable with the lower tubular section 22; and an upper section which is telescopically adjustable with the central column section 24. The upper and lower tubular column sections 22, 26 are adjustable relative to the central tubular section 24 via thumb screws 28 or other such securing devices. The disk members 16 may be any desired shape and are rotatably fitted to the central tubular member 24 and upper tubular member 26. The central column's 14 telescopic arrangement allows the two disk members 16 to be height adjusted relative to each other and to the base frame according to the space required for different size I.V. bags 30. The upper tubular section 26 and its rotatable disk 16 may be removed, if desired, to permit a portion of the refrigerator 40, seen in FIG. 2, to be utilized with shelving. Additional tubular sections 26,24, having additional rotatable disks 16 and bag holders 18, may also be added, if needed, to allow for additional I.V. bag 30 storage in larger commercial refrigerators. Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in any limiting sense.

What is claimed is:

1. A method of organizing I.V. Bags comprising the steps of:

a) loading a carousel means, for organizing I.V. Bags, comprising:

i) a support base having wheels attached thereto;

ii) a vertical tubular member attached to said support base;

iii) at least one circular member, rotatable relative to said vertical member, positionable at intervals along said vertical tubular member; and iv) a plurality of hanger arms attached to said rotatable circular member, said hanger arms being structurally sufficiently to support a plurality of liquid filled I.V. bags; and b) transporting said loaded carousel means via said wheels from a pharmacy to a nursing station.

2. A method of organizing I.V. Bags according to claim 1 wherein said carousel means is placed in a refrigerated environment and resupplied and reorganized after each nursing shift.

3. A method of organizing I.V. Bags according to claim 2 wherein said I.V. bags are arranged by patient name and in a manner whereby medical staff can readily establish a patient's sequence of medicaments.

4. A method of organizing I.V. Bags in a refrigerated environment comprising:

a) loading a carousel means, for organizing I.V. bags, comprising:

i) a support base having wheels attached thereto;

ii) a vertical tubular member attached to said support base;

iii) at least one circular member, rotatable relative to said vertical member, positionable at intervals along said vertical tubular member; and iv) a plurality of hanger arms attached to said rotatable circular member, said hanger arms being structurally sufficiently to support a plurality of liquid filled I.V. bags;

b. transporting said loaded carousel means via said wheels to a refrigerated environment such as a refrigerator used to store medicaments; and c. inserting said loaded carousel means into said refrigerated environment.

5. A method of organizing I.V. Bags in a refrigerated environment according to claim 4 wherein said carousel means is removed from said refrigerated environment and resupplied and reorganized after each nursing shift.

6. A method of organizing I.V. Bags in a refrigerated environment according to claim 5 wherein said I.V. bags are arranged by patient name and in a manner whereby medical staffers can readily establish a patient's sequence of medicaments.

* * * * *